US007066346B2

(12) United States Patent
Bazela et al.

(10) Patent No.: US 7,066,346 B2
(45) Date of Patent: Jun. 27, 2006

(54) PROTECTIVE COVERING FOR BEVERAGE CANS WITH BREAKABLE OPENING IN THE LID

(76) Inventors: Przemyslaw Bazela, ul. Tuwima 5/44, Debica 39-200 (PL); Zygmunt Kedziora, ul. Gumniska 15, Debica 39-200 (PL); Zygmunt Marcisz, ul. Nagadczyna 305, Debica 39-200 (PL)

( * ) Notice: Subject to any disclaimer, the term of this patent is extended or adjusted under 35 U.S.C. 154(b) by 41 days.

(21) Appl. No.: 10/465,925

(22) PCT Filed: Dec. 28, 2001

(86) PCT No.: PCT/PL01/00098

§ 371 (c)(1),
(2), (4) Date: Sep. 12, 2003

(87) PCT Pub. No.: WO02/053471

PCT Pub. Date: Jul. 11, 2002

(65) Prior Publication Data

US 2004/0060937 A1 Apr. 1, 2004

(30) Foreign Application Priority Data

Dec. 29, 2000 (PL) ..... 344907

(51) Int. Cl.
*B65D 51/20* (2006.01)

(52) U.S. Cl. ..... 220/257.2; 220/906

(58) Field of Classification Search ..... 220/257.2, 220/257.1, 717, 703, 705, 711–716, 906, 220/729, 790–793, 256
See application file for complete search history.

(56) References Cited

U.S. PATENT DOCUMENTS

| | | | | |
|---|---|---|---|---|
| 3,065,875 | A * | 11/1962 | Negoro | 220/784 |
| 3,250,564 | A * | 5/1966 | Stern et al. | 294/87.2 |
| 4,457,447 | A * | 7/1984 | Kirkis | 220/784 |
| 4,508,235 | A * | 4/1985 | Steele et al. | 215/307 |
| 4,938,379 | A * | 7/1990 | Kellner | 220/370 |
| 4,953,743 | A * | 9/1990 | Dart et al. | 220/369 |
| 5,103,993 | A * | 4/1992 | Bingisser | 220/782 |
| 5,381,918 | A * | 1/1995 | Dahl | 220/784 |
| 6,056,144 | A * | 5/2000 | Strange et al. | 220/297 |

* cited by examiner

*Primary Examiner*—Lien M. Ngo
(74) *Attorney, Agent, or Firm*—Ari M. Bai; Greensfelder, Hemker & Gale, P.C.

(57) ABSTRACT

Protective covering for beverage cans with breakable opening in the lid, with a circular top surface (1) and circumferential lateral surface, that consists of conical strip (3) and cylindrical strip (2) between the top surface (1) and conical strip (3). Conical strip (3) has on its internal circumferential wall unilateral wedge (4) whose front surface (5) is parallel to the top surface (1) and whose working surface (6) is convergent to the conical strip (3). The protective covering can be used to protect the lid and upper wall of a can from dirt.

3 Claims, 2 Drawing Sheets

PROTECTIVE COVERING FOR BEVERAGE CANS WITH BREAKABLE OPENING IN THE LID

Figure 1:
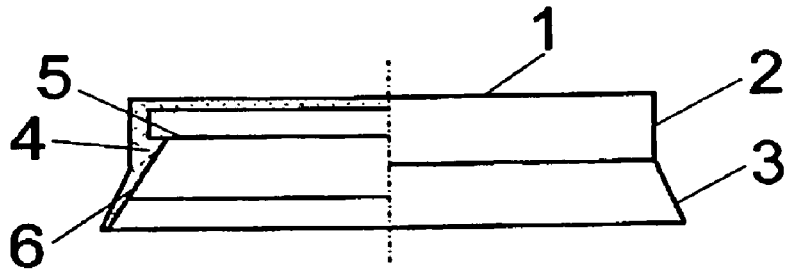

The invention relates to the protective covering for beverage cans with breakable opening in the lid.

Generally, cans with breakable opening are not equipped with any kind of protective covering so it is not possible to exclude the penetration of dust or dirt from the can surface to the digestive tract during drinking the beverage. Such dust or dirt may come from transport or exposition of cans in shops. Emptying the can to a clean vessel is not a solution since after opening a part of the can surface is dipped in the beverage.

What is more, there is no possibility of closing the can once it has been opened which again allows dirt penetrate the contents of the can and may lead to the loss of flavor and/or decay of the remaining beverage inside the can.

Patent description WO 01/23267 A1 presents a beverage can comprising a protective and method and device for placing said covering on beverage cans. This covering is made of an embossed aluminium foil deformed by an application device.

Usually, some special equipment is required to place the protective covering on the can lid. Furthermore it is impossible to fix such a covering on a can again, after it was removed.

The object of the invention is to provide a protective covering for beverage cans with breakable opening in the lid, consisting of a circular top surface and circumferential lateral surface to protect the lid and upper wall of a can from dirt. Furthermore the object of the invention is to provide a protective covering, which is easy to fix on and detach from a can; which does not require any special equipment to fix on a can and it can be fixed on a can again after detaching.

According to the invention, the circumferential lateral surface consists of conical strip and cylindrical strip between the top surface and conical strip. The conical strip has on its internal circumferential wall unilateral wedge whose front surface is parallel to the top surface and whose working surface is convergent to the conical strip.

The protective covering is placed on the can directly after its filled and closed, protecting the lid as well as the side strip of the can under the flange against dirt, and consequently providing the healthy conditions for drinking. The simple construction provides a snap connection between the front surface of the wedge and the edge of the can. The connection is strong and tight enough to prevent the drink from spilling after opening the can, even if the beverage is charged with carbon dioxide and is under pressure. Since the protective covering is made of plastic, using even small force directed from the bottom edge of circular strip to the top causes torque which makes removing of protective covering easy. Moreover, this force does not deform the protective covering so it is still possible to put it again on a can and protect the remaining contents against the decay or loss of flavour. Furthermore, the protective lid of this type is easy and cheap to produce e.g. by extrusion or injection moulding.

Preferably, according to the invention, the working surface of unilateral wedge comprises radially spaced wedge-shaped bridges separated by gaps.

This shape of wedge provides enough reliability and tightness of the snap connection. At the same time the force needed for removing the protective covering from can is relatively slight.

According to the invention, it is also appropriate if the cylindrical surface has on its external circumferential wall, at the level of the front surface of the unilateral wedge a ring-shaped projection.

The snap connection is thus more reliable, which excludes casual can opening.

Furthermore, according to the invention, it is convenient if the circular top surface has a moulding.

Moulding enables stockpiling of cans during the storage, transportation or display. Moreover it increases stiffness of the coverage top surface.

Finally, according to the invention, it is convenient to place a handle at the bottom edge of a conical strip.

The handle makes the coverage removing easier; it does not disturb, though, placing the cans side by side during the storage, transport or display when it is in vertical position.

Figure 2:
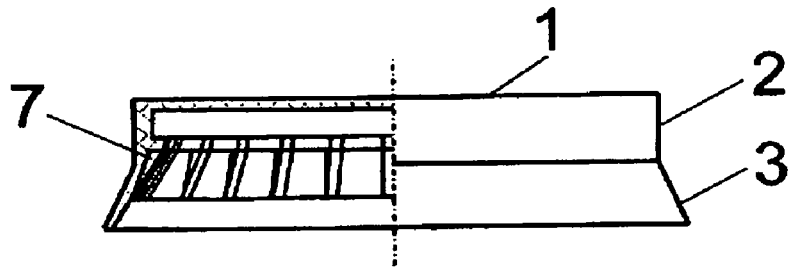
Figure 3:
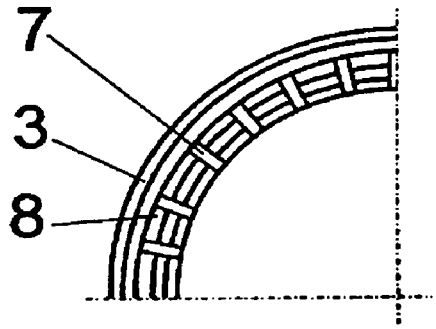
Figure 4:
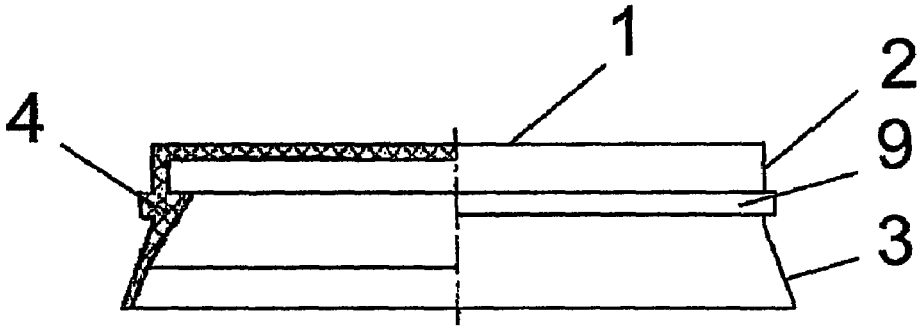
Figure 5:
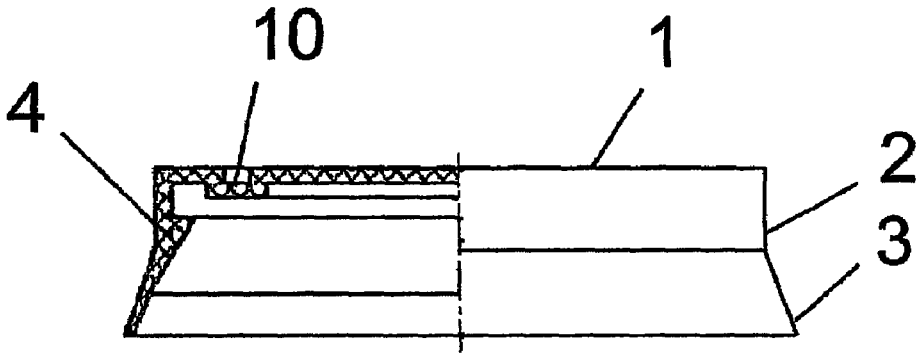
Figure 6:
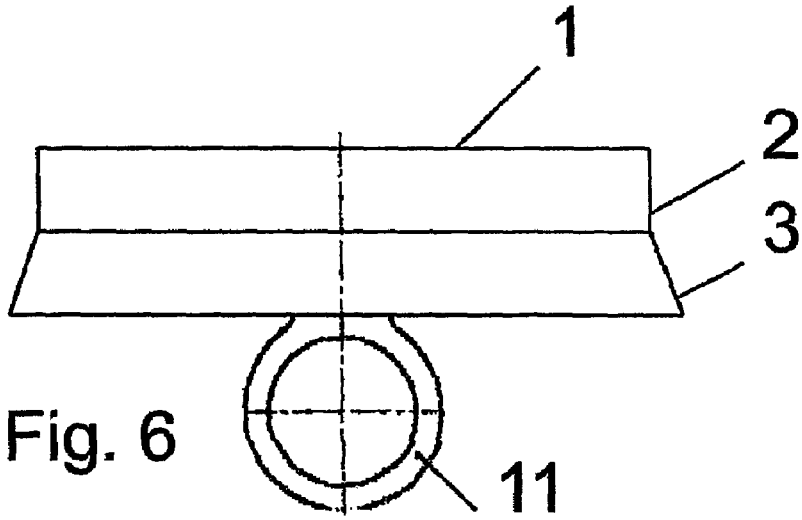

Features and advantages of the invention are explained in detail below with reference to the drawings in which, FIG. 1 shows partial vertical sectional view of a protective covering, FIG. 2 shows partial vertical sectional view of a protective covering where unilateral wedge is separated by gaps, FIG. 3 shows part of a bottom view of a protective covering shown in FIG. 2, FIG. 4 shows partial vertical sectional view of a covering provided with a ring-shaped projection, FIG. 5 shows partial vertical sectional view of a covering with the moulding on the top surface, and FIG. 6 shows a side view of protective covering with the handle.

The covering made of plastic or some other suitable elastic material consists of a circular top surface 1 and a circumferential lateral surface divided into cylindrical strip 2 supporting the circular top surface 1 and conical strip 3 adjacent to the cylindrical one. The bottom part of a conical strip 3 is thinner than a cylindrical strip 2. On internal circumferential wall of a conical strip 3 unilateral wedge 4 is provided. The front surface 5 of unilateral wedge 4 is parallel to the top surface 1 and its working surface 6 is convergent to the conical strip 3 and its inclination equals the inclination of a top part of a can, not shown in the drawing. After fixing the covering on the can, the front surface 5 snaps onto the ring shaped projection on the top of a can, thus creating the firm snap connection.

Detaching the covering from the can is relatively simple since it requires applying only a small force, directed upwards, to the bottom edge of a conical strip 3 to move the working surface 5 out of a perimeter of a ring shaped projection on top of a can at the point of applying the force.

Working surface 6 of unilateral wedge 4 is continuous on its perimeter but it may also have a form of equally and radial spaced wedge-shaped bridges 7 separated by gaps 8 as shown in FIG. 2 and FIG. 3.

The covering may also have on its external wall a ring-shaped projection 9 as shown on FIG. 4. Projection 9 improves the stability of a snap connection between the front surface 5 of unilateral wedge 4 and a bottom surface of ring shaped projection on top of a can, Furthermore, as shown on FIG. 5, the circular top surface 1 of a covering has a moulding 10, which increases the stiffness of a top surface 1 and enables stockpiling of the cans.

Finally, as shown on FIG. 6 protective covering may be provided with a handle 11 on the bottom edge of a conical surface 3. Handle 11 facilitates taking the covering off the can and fixing it on again. Its vertical arrangement is not an obstacle during transport or storing cans.

The invention claimed is:

1. Protective covering for a beverage can comprising a circular top surface and circumferential lateral surface, said circumferential lateral surface comprising a conical strip and a cylindrical strip between said top surface and said conical strip between said top surface and said conical strip, said conical strip has a unilateral wedge along an internal circumferential wall thereof, said unilateral wedge including a front surface parallel to the top surface and a working surface that is covergent to the conical strip, wherein said unilateral wedge has an inclination that is equal to the inclination of a top part of the beverage can and which comprises radially spaced wedge-shaped bridges separated by gaps.

2. The protective covering according to claim 1, wherein said conical strip includes a bottom edge, said bottom edge has a handle.

3. The protective covering according to claim 1, wherein said working surface comprises 20 to 30 radially spaced wedge-shaped bridges separated by gaps.

* * * * *